United States Patent [19]

Fujisaki et al.

[11] Patent Number: 4,486,524

[45] Date of Patent: Dec. 4, 1984

[54] TONER FOR DEVELOPING ELECTROSTATIC LATENT IMAGES COMPRISING A RESIN HAVING SPECIFIED MOLECULAR WEIGHT PARAMETERS

[75] Inventors: Yasuyuki Fujisaki, Ibaraki; Minoru Takahashi, Ujishi; Hiroshi Ogawara, Nagaokakyo; Hirozo Funaki, Osaka; Ryubun Seimaya, Hino; Yutaka Yamada, Tanashi; Makoto Tomono, Hino; Noriyoshi Tarumi, Tama, all of Japan

[73] Assignee: Konishiroku Photo Industry Co., Ltd., Tokyo, Japan

[21] Appl. No.: 321,331

[22] Filed: Nov. 13, 1981

Related U.S. Application Data

[63] Continuation of Ser. No. 211,894, Dec. 1, 1980, abandoned, which is a continuation of Ser. No. 789,941, Apr. 22, 1977, abandoned, which is a continuation-in-part of Ser. No. 566,227, Apr. 9, 1975, abandoned.

[30] Foreign Application Priority Data

Apr. 10, 1974 [JP] Japan ..... 49-41223

[51] Int. Cl.[3] ..... G03G 9/08

[52] U.S. Cl. ..... 430/109; 430/904; 430/126

[58] Field of Search ..... 430/109, 99, 126, 904

[56] References Cited

U.S. PATENT DOCUMENTS

| | | | |
|---|---|---|---|
| 3,753,909 | 8/1973 | Hulse et al. | 430/109 |
| 3,788,994 | 1/1974 | Wellman et al. | 430/109 |
| 3,941,898 | 3/1976 | Sadamatsu et al. | 430/109 X |

FOREIGN PATENT DOCUMENTS

| | | |
|---|---|---|
| 49-101032 | of 1974 | Japan . |
| 1237095 | 6/1971 | United Kingdom . |
| 1286825 | 8/1972 | United Kingdom . |

*Primary Examiner*—John D. Welsh
*Attorney, Agent, or Firm*—Jordan B. Bierman

[57] ABSTRACT

The present application relates to a novel toner for developing electrostatic latent images. The toner contains a colorant and a resin wherein the resin contains at least one particular type of polymer which has a Mw/Mn ratio of from 3.5 to 40 wherein the Mn value is about between 2,000 and 30,000.

12 Claims, No Drawings

TONER FOR DEVELOPING ELECTROSTATIC LATENT IMAGES COMPRISING A RESIN HAVING SPECIFIED MOLECULAR WEIGHT PARAMETERS

This is a continuation of Ser. No. 211,894 filed Dec. 1, 1980, which is a continuation of Ser. No. 789,941, filed Apr. 22, 1977, which is a continuation-in-part of Ser. No. 566,227, filed Apr. 9, 1975, all abandoned, and which, in turn, claims the priority of Japanese patent application No. 41223/1974, filed Apr. 10, 1974.

This invention relates to a toner for developing electrostatic latent images in electrophotography, electrostatic recording, electrostatic printing and the like.

The process of developing electrostatic latent images is roughly divided into two types; namely, a liquid developing method using a developer formed by finely dispersing a pigment or dye into an insulating organic liquid and a dry developing method using a fine powder developer; namely, a toner formed by dispersing a colorant, such as carbon black, into a natural or synthetic resin. The latter dry developing method includes a cascade method, a fur brush method, a magnetic brush method, an impression method, a powder cloud method, etc. The invention relates to a toner for use in the latter dry developing method.

Fixation is generally accomplished by fusing the toner. Fixation is conducted immediately after development, wherein permanent images are formed on a photosensitive material or other electrostatic recording material, or after image transfer which is subsequent to the development, where permanent images are formed on a transfer sheet. At the fixation step, fusion of the toner image is performed either by contacting the toner image with vapor of a solvent or by heating the toner image. As the heating method, there is generally adopted a noncontact heating method using an electric furnace or a press heating method using a heated roller.

According to the press heating method, there is employed a heated roller having a surface composed of a material having a releasing property to the toner. The roller is contacted with a sheet on which an image is to be fixed so that it is pressed to the toner image surface, whereby fixation is accomplished. In this heating method, which is generally called "a heated roller fixing method", since the surface of the heated roller is pressed with the toner image-carrying surface of a sheet on which the toner image is to be fixed, a good thermal efficiency can be attained in fusion of the toner image to the fixing sheet and fixation can be accomplished very promptly. Therefore, this fixing method is advantageously utilized for electrophotographic copying machines of the transfer type in which high speed reproduction is intended. In this case, however, since the surface of the fixing roller is pressed with the toner image, a part of the toner image adheres to the fixing roller surface and is re-transferred to a subsequent fixing sheet. This results in a so-called offset phenomenon and sometimes results in the staining of the fixing sheet. Therefore, in the heated roller fixing method, it is required that the toner does not adhere to the roller surface.

As means for preventing a toner from adhering to the surface of a fixing roller, there has been adopted a method in which a roller, having a surface composed of a material having a good releasing property to the toner, (fluorine resin) is used. Then, offset-preventing liquid such as a silicone oil is fed to the surface of the roller to cover the roller surface with a liquid film. This method is effective for preventing occurrence of toner offset phenomenon. However, an unpleasant smell is generated because the offset-preventing liquid is heated. Since it is necessary to provide an apparatus for feeding the offset-preventing liquid, the mechanism of the copying machine is complicated and the cost of the copying machine in which high accuracy is required for obtaining good results becomes high. However, the use of an offset-preventing liquid cannot be avoided since the toner would otherwise adhere to the surface of the fixing roller.

It is therefore a primary object of this invention to provide a toner for developing electrostatic latent images which makes it possible to perform heated roller fixation at a high efficiency without occurrence of offset phenomenon.

We found that the above object can be attained by utilizing a toner for developing electrostatic latent images comprising a resin, containing as a structural unit an $\alpha$, $\beta$-unsaturated ethylenic monomer and having a weight average molecular weight ($M_w$)/number average molecular weight ($M_n$) ratio of from 3.5 to 40, as a main resin component.

When the toner of this invention for developing electrostatic latent images is employed, even if an offset-preventing liquid is not fed to the surface of a fixing roller, the heated roller fixation can be accomplished at a high efficiency without occurrence of offset phenomenon. Therefore, if the toner of this invention is employed, the mechanism of the fixing device can be simplified. This results in an accurate high speed copying operation in which the cost of copying can be reduced.

In general, toners comprise a resin component, a coloring component composed of a pigment or dye, a plasticizer and additives for adjusting physical properties and developing characteristics of the toner, such as a charge-controlling agent. Natural or synthetic resins are used alone or in blends as the resin component. In some cases, it is possible to use as the resin component a colored polymer containing a dye bonded to the polymer chain.

Generally, the toner of this invention for developing electrostatic latent images comprises a resin, containing as a structural unit an $\alpha$, $\beta$-unsaturated ethylenic monomer and having a weight average molecular weight number average molecular weight ratio (referred to as $M_w/M_n$ ratio hereinafter) of from 3.5 to 40. (hereinafter referred to as "the resin of this invention") as the main resin component. In short, the toner of this invention is characterized in that it comprises the above-mentioned resin as a main resin component. More specifically, when the resin of this invention is incorporated into a toner in an amount of at least about 60% by weight, preferably at least 75% by weight, based on the total resin component of the toner, occurrence of offset phonomenon of the toner to a heating fixing roller can be effectively prevented.

The first characteristic of the resin of this invention is that it comprises a $\alpha$, $\beta$-unsaturated ethylenic monomer as a main structural component. The resin of this invention may be a homopolymer composed of one monomer alone or a copolymer composed of two or more monomers. Further, the resin of this invention may be a polymer blend comprising two or more of such homopolymers and or copolymers.

Advantageously, the resin composition comprises a uniform mixture of a polymer having a low degree of polymerization (low polymer) and a polymer having a high degree of polymerization high polymer), said composition is characterized as having a number average molecular weight (Mn) in the range of between about 2,000 and 30,000, a weight average molecular weight (Mw)-to-number average molecular weight (Mn) ratio in the range of between about 3.5 and 40, and a glass transition point in the range of between about 20° to 120° C. Additionally, there is disclosed a process for the preparation of a resin composition comprising a uniform mixture of a low polymer and a high polymer characterized as having a number average molecular weight (Mn) in the range of between about 2,000 and 30,000, a weight average molecular weight (Mw)-to-number average molecular weight (Mn) ratio in the range of between about 3.5 and 40, and a glass transition point in the range of between about 20° and 120° C., which comprises polymerizing a mixed solution of 100 parts by weight of a polymerizable monomer and 5–60 parts by weight of a high polymer having a number average molecular weight in the range of between about 100,000 and 500,000.

More particularly, the resin composition in accordance with the present invention comprises a uniform mixture of a low polymer and a high polymer having a number average molecular weight (Mn) of between about 2,000 and 30,000 and a ratio, obtained by dividing (Mw) by (Mn) (i.e. Mw/Mn), of between about 3.5 and 40, preferably between about 4 and 20. All the values for Mn and Mw as described herein are values measured by gel permeation chromatography (GPC) under the following conditions: 3 mg of a sample resin in solution form are injected into the solvent tetrahydrofuran having a temperature of 25° C. and a rate of flow of 1 ml/min such that the concentration of the sample is maintained at about 0.4 g/dl.

The measurement conditions are selected such that the molecular weight distribution of the sample is within the range where a linear relationship is developed between logarithmic values of molecular weight and count numbers in a calibration curve prepared with several different monodisperse polystyrene standard samples. In addition, reliability of such measurement can be confirmed by testing a NBS 705 polystyrene standard sample ($Mw=28.8\times10^4$, $Mn=13.7\times10^4$, $Mw/Mn=2.11$) under the same conditions. This sample gives a Mw/Mn value of $2.11+0.10$.

Both the low polymer and the high polymer in the resin composition of the present invention are prepared by polymerizing one or more polymerizable vinyl monomers. The vinyl monomers constituting the low polymer may be the same as or different than the vinyl monomers constituting the high polymer. Vinyl monomers of the low and high polymers include aromatic vinyl monomers such as styrene, α-methylstyrene and chlorostyrene; acrylic acid; acrylic acid esters such as methyl acrylate, ethyl acrylate, propyl acrylate, butyl acrylate and octyl acrylate; methacrylic acid; methacrylic acid esters such as methyl methacrylate, ethyl methacrylate, propyl methacrylate, butyl methacrylate, octyl methacrylate, stearyl methacrylate and glycidyl methacrylate; and acrylonitrile. Monomer compositions having styrene or methacrylic acid esters as a main component are particularly preferred.

The ratio of the low polymer to the high polymer in the resin composition of the present invention is by no means limited. It is preferred to use between about 5 and 60 parts by weight of a high polymer, having a number average molecular weight in the range of between about 100,000 and 500,000, per 100 parts by weight of a low polymer having a number average molecular weight of not more than about 30,000.

As previously stated, the resin composition in accordance with the present invention has Mn and Mw/Mn values within a specific range. Additionally, the resin composition is required to have a glass transition point in the range of between about 20° and 120° C. A resin composition comprising a uniform mixture of a low polymer and a high polymer and meeting the aforementioned requirements for Mn, Mw/Mn, and glass transition point is extremely useful as a base resin for a powder coating composition and the like. Thus, the resin composition in accordance with the present invention is easily ground but withstands excessive grinding into a powder having excessively fine particles. In other words, it is possible to obtain a powder having a high yield of particle sizes within the desired range. When the present resin composition is used in a powder coating composition or as a toner for dry type electrophotography, it withstands crushing caused by friction and thus, does not form excessively fine particles.

In addition to these advantages, if the resin composition of the present invention is heated, it begins to melt at a relatively low temperature and elevation to a somewhat higher temperature results in a relatively small decrease in the cohesive force. Thus, the present resin composition exhibits little deterioration when exposed to changes in temperature. For example, when the resin composition is used as a base resin for a powder coating composition, a slight change in baking temperature does not result in deterioration of surface smoothness, adhesion to substrates, uneveness in thickness or resin hanging phenomenon at the edges of the coating film. In addition, it is possible to select the baking temperature from a relatively wide temperature range which permits a wide selection of operable curing agents.

The second characteristic of the resin of this invention is that the $M_w/M_n$ ratio is within a range of from 3.5 to 40. In case the resin of this invention is composed of one homopolymer or copolymer, the value of the above ratio is that of said homopolymer or copolymer, and in case the resin of this invention is a polymer blend, said value is the value of the polymer blend as a whole. More specifically, in the case of a polymer blend, it is not absolutely necessary that the value $M_w/M_n$ should be from 3.5 to 40 in each of constituent polymers but it is sufficient that the value $M_w/M_n$ of the polymer blend as a whole is from 3.5 to 40.

As the α, β-unsaturated monomer to be used as the constituent of the resin of this invention, there can be mentioned, for example, styrene monomers such as styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene and 3,4-dichlorostyrene; vinylnaphthalenes; unsaturated mono-olefins such as ethylene, propylene, butylene and isobutylene; vinyl esters such as vinyl chloride, vinyl bromide, vinyl fluoride, vinyl acetate, vinyl propionate, vinyl benzoate and vinyl butyrate; α-methylene aliphatic monocarboxylic acid esters such as methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate and diethylaminoethyl methacrylate; acrylic acid and methacrylic acid derivatives such as acrylonitrile, methacrylonitrile and acrylamide; vinyl ethers such as vinylmethyl ether, vinylethyl ether and vinylisobutyl ether; vinyl ketones such as vinylmethyl ketone, vinylhexyl ketone and methylisopropenyl ketone; and N-vinyl compounds such as N-vinylpyrrole, N-vinylcarbazole, N-vinylindole and N-vinylpyrrolidine. The resin of this invention includes those formed by acetalizing polymers, such as polyvinyl acetals, e.g., polyvinyl butyral. Among these monomers, aromatic vinyl monomers and α-methylene aliphatic monocarboxylic acid esters are especially preferred, and especially good effects can be obtained when resins containing such monomers as the main structural component are employed in this invention. Moreover, a resin containing monomers of the foregoing two types in which the styrene type monomer content is at least about 30 mole % is especially preferred, because such resin is excellent in not only the offset-preventing effect but also the properties required of the toner at the manufacturing steps (i.e. triboelectric property, the pulverizing property and the uniform additive dispersibility).

The toner for developing electrostatic latent images, including the above-mentioned resin of this invention as the main resin component, is characterized as not causing offset phenomenon and having a broad fusing temperature range. Because of these characteristics, the toner is hardly influenced by changes in the temperature at the fixing step and design of the fixing device can be greatly facilitated.

As pointed out hereinabove, the intended object of this invention can be attained by using a resin having an $M_w/M_n$ ratio ranging from 3.5 to 40, but an especially high offset-preventing effect can be attained when a resin having an $M_w/M_n$ ratio of from 4.0 to 30 is employed.

In preparing toners, after the resin component has been compounded with a coloring component and additives, the kneading step using a kneader is generally carried out. A massive toner composition obtained by the kneading treatment is then pulverized and sieved to collect a toner having a desired particle size. Toner particles removed by the sieving treatment are kneaded again by means of kneader, followed by pulverizing and sieving. The overall yield is increased by repeating the above procedures. However, since a shearing force is imposed on the resin component of the toner at the kneading step using a kneader, the main chain of the resin is cut to change the structure and molecular weight of the resin. Even when the molecular weight of the resin is changed more or less by the first kneading operation, if the $M_w/M_n$ value is maintained within a range of from 3.5 to 40, the intended object of this invention can be attained. But, while the kneading operation is repeated as mentioned above so as to increase the yield, it sometimes happens that the molecular weight of the resin is gradually changed to such an extent that the $M_w/M_n$ value is reduced below 3.5 or it is increased beyond 40. In such case, a toner capable of attaining the object of this invention cannot be obtained at all, and, therefore, the yield of the intended toner is decreased. Increase of the yield is one of important factors in the production of toners. Among resins of this invention, those having an $M_w/M_n$ ratio ranging from 4.0 to 30 are especially preferred. More specifically, when the $M_w/M_n$ value is within the range of 3.5 to 40, even if the kneading operation is repeated, there is attained an advantage that the yield of the toner can be greatly improved.

Especially good results are obtained when the resin of this invention has a softening point of about 100 to about 170° C. as measured according to the Ball and Ring method. The preferred softening point varies to some extent depending on the kind of the monomer included as the resin constituent and other factors. Moreover, use of a resin having a glass transition point of about 20° to about 120° C. is especially effective. In case the resin of this invention has a softening point lower than 100° C., the resin tends to be excessively pulverized and a photoconductive photosensitive plate is readily stained by the toner filming. When the softening point of the resin exceeds 170° C. pulverization is made difficult because of the hardness of the resin and a large heat is required at the fixing step, causing a defect of a low fixing efficiency. When the glass transition point of the resin is lower than 20° C., since the toner is generally stored at a temperature lower than 40° C., agglomeration of the toner particles occurs during storage by the cold flow phenomenon. When the glass transition point of the resin exceeds 120° C., if the material of the fixing roller is other than a metal, for example, Teflon (polytetrafluoroethylene manufactured by Du Pont), the roller material is readily worn away at temperatures higher than 250° C. and is decomposed at such temperatures. Therefore, there is brought about a disadvantage that elevation of the fixing temperature is limited by the roller-constituting material and the fixation cannot be accomplished sufficiently when the fixation is conducted at a high speed.

Incidentally, there is observed a tendency that as the value $M_w/M_n$ increases, the glass transition point of the resin comes to have a certain width and does not show a certain specific value. In some resins having a large $M_w/M_n$ value, it is difficult to measure the glass transition point.

The toner of this invention for developing electrostatic latent image comprises the above-mentioned resin of this invention as a main resin component, and the resin component of the toner of this invention may either be composed of the resin of this invention alone or further comprise other polymers or resins according to need. As resins that can be used in combination with the resin of this invention, there can be mentioned resins containing no α, β-unsaturated ethylenic monomer as a monomer component, for example, non-vinylic resins such as rosin-modified phenol-formalin resins, epoxy resins, polyurethane resins, cellulose resins and polyether resins. The kind and amount of such additional resin are chosen and determined appropriately depending on the kind of the resin of this invention, the kind of the monomer constituting the resin of this invention, the copolymerization ratio of monomers when the resin of this invention is a copolymer, the molecular weight of the resin of this invention, the softening point of the resin of this invention, the glass transition point of the resin of this invention and the like. For example, though the resin of this invention to be used as the main resin component of the toner is sufficient in the offset-preventing effect, it sometimes happens that it is insufficient or defective in that the toner is too soft to impart a sufficient pulverizing property at the toner-preparation steps or show a sufficient triboelectric property or the resin fails to provide a stable toner or a toner resistant to agglomeration. In such case, incorporation of a xylene resin is effective for overcoming such disadvantages and providing a toner having good quality. Further, if the main component of the toner is composed solely of a polystyrene resin included in the scope of this invention, the resin is too brittle and readily overpulverized. In such case, incorporation of an epoxy resin is effective for overcoming this disadvantage.

When the present resin composition is used as the base resin of a toner for dry-type electrophotography, a beautiful image, unaffected by variance in the fixing temperature, having good adhesion to paper can be obtained. Furthermore, even when the temperature increases at the time of melting, the decrease of cohesive force is relatively small. Therefore, when the resin composition is used as a base resin for a toner and is brought into direct contact with a heating plate in a high speed copying process, it will not adhere to the heating plate not bring about offset phenomenon. It is therefore possible to carry out the fixing step at high speeds while maintaining good thermal efficiency.

In the present invention, it is advantageously required that a low polymer is uniformly mixed with a high polymer. In order to insure uniformity of the mixture, melting of both polymers followed by mechanical mixing of the melts is insufficient since a higher degree of mixing is required. Methods of effecting such uniform mixing include a method wherein both the low and high polymers are dissolved in a solvent, mixed well therein, and the solvent is then removed to provide the desired mixture. Another method involves dissolving the high polymer in a polymerizable monomer to form a mixed solution and the resulting mixed solution is then subjected to polymerization in a customary manner. The latter method is preferred because of the simplicity of the process.

In such a uniform mixture, the high molecular weight portion and the low molecular weight portion together form a complete whole. The high molecular weight portion contributes to the protection of the resin composition against reduction of the cohesive force at the time of melting. The low molecular weight portion insures proper melting in that the resin composition begins to melt at a relatively low temperature but does not lose its cohesive force when the temperature rises. Also, the high molecular weight portion adds toughness to the resin composition. The low molecular weight portion allows the resin to be easily ground. These characteristics permit the formation of particles having the desired particle size.

In addition to its use in powder coating compositions and toners for dry-type electrophotography, the resin composition is useful in hot melt adhesives, various pigment binders, metal coating composition, etc. In some instances it may be preferable to employ the resin composition having a softening point, as measured by the ring and ball method, in the range of between about 100° and 170° C.

The process for the preparation of the resin composition in accordance with the present invention comprises dissolving a high polymer in a polymerizable monomer to form a mixed solution and subjecting the resultant mixed solution to polymerization. The high polymer used in this process preferably has a number average molecular weight in the range of between about 100,000 and 500,000 and is preferably used in an amount in the range of between about 5 and 60 parts by weight per 100 parts by weight of the polymerizable monomer. The polymerization is carried out under such conditions that the resultant resin composition has a Mn value of between about 2,000 and 30,000 a Mw/Mn value of between about 3.5 and 40, and a glass transition point of between about 20° and 120° C. If a standard polymerization process is employed wherein a polymerizable monomer is directly polymerized into a polymer, the value of Mn can be varied over a wide range by varying the polymerization conditions. However, Mw/Mn values can only be obtained in the range of between about 1.5 and 3.0.

In carrying out polymerization in accordance with the process of the present invention, initiators which are commonly used in polymerization of vinyl monomers, such as lauroyl peroxide, benzoyl peroxide, tert-butyl peroxide and azobisisobutyronitrile, are used in relatively large amounts (i.e. in amounts of not less than 2 parts by weight per 100 parts by weight of the monomer).

Methods of polymerization operable in the present process include any conventional polymerization methods, such as bulk polymerization, solution polymerization, and suspension polymerization. If bulk polymerization is used, low polymers can be prepared by accelerating the velocity of the end portion of the reaction. In order to prepare a mixed solution of a polymerizable monomer with a high polymer, the high polymer, which has been previously prepared by polymerization, may be added to and dissolved in the polymerizable monomer. Alternatively, the polymerizable monomer may be polymerized at a low temperature and the polymerization interrupted in the initial stage thereof to incorporate the polymerizable monomer into the high polymer. If a solution polymerization method is used, low polymers can be obtained by utilizing the chain transfer reaction of radicals with the solvent employed. Also in this method, in order to prepare a mixed solution of a polymerizable monomer and a high polymer, the high polymer, which has been previously prepared, may be added to a solution of the polymerizable monomer.

Alternatively, the polymerizable monomer may be polymerized at low temperatures and the polymerization interrupted in the initial stage thereof.

The bulk polymerization method is disadvantageous in that it must by carried out while stirring the monomer solution containing a high polymer. The high polymer may be fragmented due to the shearing force generated by stirring. The solution polymerization method is also disadvantageous in that it requires the use of solvents which necessitates the additional steps of removing and recovering the solvents.

In contrast, the suspension polymerization method does not result in molecular fragmentation because shearing forces are not produced. Additionally, solvents are not employed in this method. In addition to these advantages, the resin composition obtained by the suspension polymerization method produces pearl-shaped uniform particles which are easy to separate and wash.

To prepare a mixed solution of a polymerizable monomer with a high polymer by the suspension polymerization method, a previously prepared high polymer may be dissolved in the polymerizable monomer to give a mixed solution. The mixed solution is then suspended. Alternatively, the polymerizable monomer may be added to and mixed by stirring with a polymer suspension system. This system is prepared by subjecting the polymerizable monomer to suspension polymerization in order to prepare a monomer solution in suspension form wherein the polymer is dissolved in the monomer. Other methods of dissolving the high polymer in the polymerizable monomer may be employed.

For the reasons outlined above, the suspension polymerization method is preferred in the process in accordance with the present invention. In this method, however, polymerization initiators are used in high concentration in order to obtain a low degree of polymerization. Additionally, the viscosity of the reaction system is increased as the high polymer is dissolved in the monomer, thus giving rise to the so-called gel effect. As a result, excessive heat is generated in this polymerization system. The present inventive efforts have succeeded in solving this problem.

Thus, when α-methylstyrene is used as part of the polymerizable monomer, the α-methylstyrene acts as a polymerization retarder to depress the heat generated in the polymerization system. This permits control over the polymerization reaction. In addition to this advantage, the use of α-methylstyrene allows the further lowering of the polymerization degree of the resultant polymers. Thus, the easy preparation of polymers, having low polymerization degrees, can be achieved by using α-methylstyrene as part of the polymerizable monomer as well as relatively large amounts of polymerization initiators in the suspension polymerization method.

Further, conventional processes for the preparation of low polymerization degree polymers utilize mercaptans as chain transfer agents. However, mercaptans possess an odor which is retained in the final product and markedly reduces its commercial value. The present invention eliminates the use of mercaptans and thereby eliminates this problem.

When the suspension polymerization method is employed in the process of the present invention, the high polymer is dissolved in the polymerizable monomer and therefore the viscosity of the suspended particles in the initial stage of the polymerization system is high. This contributes to the stability of the suspension system, prevents the monomer from transferring into water to preclude the formation of excessively fine powder. Further, this minimizes contamination with impurities, such as suspension stabilizers, which are detrimental to the final product.

The present invention is now explained with reference to the following examples. All measurements are in parts by weight unless otherwise indicated.

SYNTHESIS EXAMPLE 1

10 parts of polystyrene, having a number average molecular weight of $12\times10^4$, was added to and dissolved in the monomer-benzoyl peroxide mixture, shown below in column A of Table 1, to obtain a mixed solution. The solution was suspended and dispersed in 200 parts of water having dissolved therein 0.5 part of a partially saponified polyvinyl alcohol. The resultant mixture was subjected to polymerization at a polymerization temperature of 30° C. to obtain resin composition A consisting of a uniform mixture of a low polymer and a high polymer.

For the purpose of comparison, the same procedure as above was employed to prepare compositions B and C. The only exception was the omission of polystyrene as the high polymer. Measurements of Mn, Mw/Mn, glass transition temperature, and softening point by the ring and ball method were made on resin composition A and resins B and C. The results are shown in Table 1.

TABLE 1

| | A | B | C |
|---|---|---|---|
| Polystyrene | 10 parts | 0 part | 0 part |
| Monomer: | | | |
| Styrene | 70 parts | 70 part | 70 part |
| n-Butyl methacrylate | 30 parts | 30 part | 30 part |
| α-Methylstyrene | 5 parts | 5 part | 3 part |
| Benzoyl peroxide | 3 parts | 3 part | 2 part |
| Physical properties: | | | |
| Mn | $1.1\times10^4$ | $1.1\times10^4$ | $2.3\times10^4$ |
| Mw/Mn | 4.2 | 2.0 | 2.1 |
| Glass transition temperature | 72° C. | 72° C. | 72° C. |
| Softening point by the ring and ball method | 124° C. | 115° C. | 125° C. |

Upon melting, the behavior of resin composition A and resins B and C were checked by use of the Koka flow tester (diameter of outlet nozzle 1 mm; length of outlet nozzle 1 cm; plunger pressure 100 kg/cm$^2$; rate of temperature increase 6° C./min.). Both resin composition A and resin B were found to begin to melt at approximately 100° C., while resin C did not begin to melt until the temperature reached approximately 110° C.

Furthermore, changes in melt viscosity of the polymers due to changes in temperature were also checked. Resin composition A showed smaller melt viscosity changes resulting from temperature changes than resins B and C. Thus, although beginning to melt at a relatively low temperature, resin composition A retained "substantial viscosity".

In a 24 hour ball mill grinding test, resins B and C were ground into particles which resulted in an excessively fine powder having a wide particle size distribution. Under the same grinding test, resin composition A gave particles showing a relatively narrow particle size distribution and little excessively fine powder.

SYNTHESIS EXAMPLE II 37.5 parts of styrene, 30 parts of n-butyl acrylate, 7.5 parts of glycidyl methacrylate and 0.2 part of benzoyl peroxide were mixed together in a reaction vessel. The mixture was polymerized at 30° C. until a polymerization degree of 20% was achieved. Thereafter, the reaction mixture was cooled and charged with 10 parts of styrene, 16 parts of n-butyl acrylate and 14 parts of glycidyl methacrylate to provide a mixed solution. The thus obtained mixed solution was found to consist of 15 parts of a high polymer (monomer composition: styrene/n-butyl acrylate/glycidyl methacrylate=50/40/10; Mn $12\times10^4$), 40 parts of styrene, 40 parts of n-butyl acrylate and 20 parts of glycidyl methacrylate. 3 parts of benzoyl peroxide were added to the mixed solution and the resultant mixture, at its boiling temperature, was continuously added dropwise for four hours to 200 parts of toluene. After the dropwise addition was completed, the mixture was kept at the boiling temperature for an additional two hours to complete polymerization. The resultant reaction mixture was dried in a vacuum to remove the toluene. Resin composition D was obtained consisting of a uniform mixture of a low polymer and a high polymer.

For the purpose of comparison, 3.1 parts of benzoyl peroxide were added to a monomer mixture consisting of 40 parts of styrene, 40 parts of n-butyl acrylate, and 20 parts of glycidyl methacrylate. The resultant mixture was added dropwise to 200 parts of toluene in the same manner as described above and then polymerized to obtain resin E. The value of Mn was 5500 for resin composition D and 8000 for resin E. The value of Mw/Mn was 3.2 for resin composition D and 2.4 for resin E. The glass transition temperature was 23° C. for both resin composition D and resin E.

Subsequently, 30 parts of titanium oxide and 12 parts of sebacic acid were added to each of resin composition D and resin E. Each of the mixtures was melted and blended at 120° C. to obtain a composition. In a 24 hour ball mill grinding test, the composition containing resin composition D gave particles having a lower amount of excessively fine powder and an 80% yield of particles having a particle size distribution in the range of between about 20 and 50 microns. Particles in this size range are preferable for use in powder coating compositions. The composition containing resin E showed particles having a wide particle size distribution and a large amount of excessively fine powder. The yield of particles in the above-described preferred range was 45%.

Each of the thus obtained powdered products was applied to an iron plate and heated to 200° C. The powder coating composition based on resin E was found to show resin hanging and uneven thickness at the edge portions. The powder coating composition based on resin composition D did not show such drawbacks and provided a coating film with a beautiful, smooth surface.

SYNTHESIS EXAMPLE III 40 parts of styrene, 30 parts of methyl methacrylate, 30 parts of n-butyl methacrylate and 0.17 part of azobisisobutyronitrile were added to, suspended, and then dispersed in 200 parts of water containing 0.5 part of a partially saponified poylvinyl alcohol. The resultant mixture was subjected to polymerization at 75° C. to obtain a high polymer having an Mn value of $2.0\times10^4$.

Subsequently, 10 parts of the thus obtained high polymer were mixed with the monomer-azobisisobutyronitrile mixture, shown in column F of Table 2, to obtain a mixed solution. The mixed solution was added to, suspended, and then dispersed in 200 parts of water containing 0.5 part of a partially saponified polyvinyl alcohol. The resultant mixture was subjected to polymerization at 75° C. to obtain a resin composition consisting of a uniform mixture of a low polymer and a high polymer.

For the purpose of comparison, the same procedure as described above was employed to prepare resin G as shown in Table 2. The only exception was the omission of polystyrene as the high polymer.

Measurements of Mn, Mw/Mn, glass transition temperature and softening point by the ring and ball method were made on each of these products. The results are shown in Table 2.

TABLE 2

| | F | G |
|---|---|---|
| Polystyrene | 10 parts | 0 part |
| Monomer: | | |
| Styrene | 40 parts | 40 part |
| Methyl methacrylate | 30 parts | 30 part |

TABLE 2-continued

| | F | G |
|---|---|---|
| n-Butyl methacrylate | 30 parts | 30 part |
| α-Methylstyrene | 6 parts | 3 part |
| Azobisisobutyronitrile | 4.5 parts | 3 part |
| Physical properties: | | |
| Mn | $2.2\times10^4$ | $2.9\times10^4$ |
| Mw/Mn | 4.6 | 2.3 |
| Glass transition temperature | 73° C. | 73° C. |
| Softening point by the ring and ball method | 134° C. | 136° C. |

5 parts of Diablack SH (manufactured by Mitsubishi Kasei, Co., Ltd.) and 2.5 parts of Oilblack BW (manufactured by Orient Kaguka, Co., Ltd.) were melt-blended with individual samples of 100 parts each of resin composition F and resin G. The resultant blends were ground for 50 hours by a ball mill. The average particle size of the powder containing resin composition F was 15.2 microns, whereas that obtained from resin G was 10.2 microns. The yield of the powder having a desired particle size distribution in the range of between about 10 and 20 microns was about 75% for resin composition F and 35% for resin G. The above-mentioned particle size range is suitable for use in a dry-type electrophotographic toner. In addition, the sample containing resin G showed a large amount of finely divided particles having a size of less than 10 microns. These fine particles are undesirable because they produce a blocking effect. The sample containing resin composition F showed few of these finely divided particles and therefore, blocking does not occur. The thus obtained powder samples, having a particle size distribution in the range of between about 10 and 20 microns for use as a toner, were subjected to fixing at different temperatures in the range of between about 150° and 200° C. The toner containing resin G exhibited excessive fluidity at higher temperatures, a decrease in resolution, excessive luster of the resulting image, etc. The toner containing resin composition F exhibited beautiful images over the entire range of fixing temperatures.

SYNTHESIS EXAMPLE IV 0.1 of a partially saponified polyvinyl alcohol (Gosenol GH-17 manufactured by Japanese Synthetic Rubber) was charged in a separable flask having a capacity of 1 liter, and dissolved in 100 ml of distilled water. Then, a monomer mixture A indicated in the following Table was added to the solution to suspend and disperse the mixture in the solution. The atmosphere was replaced by nitrogen gas and the temperature was elevated to 80° C. At this temperature polymerization was carried out for 15 hours. The reaction mixture was cooled to 40° C., and a monomer mixture B indicated in the following Table was added to the reaction mixture and the mixture was agitated at 40° C. for 2 hours. Separately, an aqueous solution of 0.4 g of a partially saponified polyvinyl alcohol (Gosenol GH-17) in 100 ml of distilled water was prepared. The so formed aqueous solution was added to the above suspension. Then, the temperature was elevated again to 80° C. and this temperature was maintained for 8 hours to effect the polymerization. Then, the temperature was further elevated to 95° C. and this temperature was maintained for 2 hours to complete the polymerization. The reaction product was cooled, dehydrated, washed repeatedly and dried to obtain a resin in which the Mw/Mn ratio was 5.4, the Mn value was $1.1\times10^4$ and the softening as measured according to the ball and ring method was 140±2° C.

| Monomer | Monomer Mixture A | Monomer Mixture B |
|---|---|---|
| styrene | 5 g | 50 g |
| methyl methacrylate | 2 g | 20 g |
| butyl methacrylate | 3 g | 30 g |
| benzoyl peroxide | 0.02 g | 2 g |
| α-methylstyrene (dimer) | — | 3 g |

The α-methylstyrene (dimer) used was a mixture of 2,4-diphenyl-4-methyl-1-pentene and 2,4-diphenyl-4-methyl-2-pentene synthesized according to the disclosure of the specification of U.S. Pat. No. 2,429,719 and a fraction having a refractive index of 1.569 was employed.

In the toner of this invention for developing electrostatic latent images, an optional appropriate pigment or dye is used as a colorant. For example, there can be employed carbon black, Nigrosine dyes, aniline Blue, Chalco Oil Blue, Chrome Yellow, Ultramarine Yellow, Du Pont Oil Red, Quinoline Yellow, Methylene Blue Chloride, Phthalocyanine Blue, Malachite Green Oxalate, lamp black, Rose Bengale, and mixtures thereof. It is necessary that such colorant should be incorporated in an amount enough to color the toner so that a visible image can be obtained.

In the toner of this invention for developing electrostatic latent images, occurrence of the offset phenomenon of the toner can be effectively prevented by using the resin of this invention as the main resin component of the toner. In order to further enhance the offset-preventing effect, if desired, it is possible to incorporate into the toner a compound capable of releasing property. As such compounds, there can be mentioned, for example, metal salts of fatty acids such as cadmium stearate, barium stearate, lead stearate, nickel stearate, cobalt stearate, copper stearate, strontium stearate, calcium stearate, magnesium stearate, zinc oleate, manganese oleate, iron oleate, cobalt oleate, copper oleate, lead oleate, magnesium oleate, zinc palmitate, cobalt palmitate, copper palmitate, magnesium palmitate, aluminum palmitate, calcium palmitate, zinc linoleate, cobalt linoleate, calcium linoleate, zinc ricinoleate, cadmium ricinoleate, lead caprylate and lead caproate; higher fatty acids having at least 28 carbon atoms; natural and synthetic paraffins; fatty acid esters and partially saponified products thereof; and alkalene-bis-fatty acid amides such as ethylene-bis-stearoyl amide. These compounds are used singly, or two or more of them are combined appropriately. Such compound is incorporated in the toner in an amount of 0.1 to 10 parts by weight, preferably 0.5 to 5 parts by weight, per 100 parts by weight of the resin component of the toner. By incorporation of such compound, the dispersability of other toner additives such as a colorant and a charge-controlled agent into the resin component can be improved. Further, in the event the resin component is relatively brittle, the incorporation of such compound prevents excessive pulverization in the grinding step in the toner-preparing process, and, hence, a toner of a desired particle size can be obtained in a high yield. Moreover, such releasing property-imparting compound exhibits effects of increasing the stability of the toner, preventing the change of the triboelectric property even in the case of a long-time use and prolonging the life of the toner.

The resin of this invention may be used as the resin component of a toner for use in a development, where a developer consists of the toner containing a magnetic material.

In such toner, the magnetic material serves as a colorant.

According to need, the toner of this invention for developing electrostatic latent images may further comprise other various toner additives such as a charge-controlling agent and a plasticizer.

A toner image formed on a fixing sheet by using the toner of this invention for developing electrostatic latent images can be conveniently fixed on the fixing sheet at a high efficiency without occurrence of the undesired offset phenomenon according to the heated roller fixing method even when a fixing roller of the type where an offset-preventive liquid is not fed to the surface of the roller is employed. Fixing rollers having a smooth surface composed of a fluorine resin such as Teflon (manufactured by Du Pont), FEP (manufactured by Du Pont), Fluon (manufactured by ICI), Kel F (manufactured by 3M) and Daifuron (manufactured by Daikin) or a relatively hard silicone rubber such as KE-1300 RTV (manufactured by Shinetsu Kagaku) are effectively employed for the heating roller fixing treatment. In some cases, a fixing roller having a metal surface can be effectively employed.

This invention will now be described in detail by reference to the following Examples that by no means limit the scope of this invention. In the Examples, all of "parts" are by weight unless otherwise indicated.

EXAMPLE 1

100 parts of polystyrene (A)[Mw/Mn=3.7; Mn=9600; softening point as measured according to the ball and ring method (hereinafter referred to as "B & R") =120±2° C.; glass transition point (hereinafter referred to as "Tg")=97° C.] was mixed with 6 parts of Peares 155 (carbon black manufactured by Columbia Carbon) and 3 parts of Higrosine Base EX (Nigrosine dye manufactured by Orient Kagaku), and the mixture was treated in a ball mill for about 24 hours and kneaded with a hot roll. Then, the mixture was cooled and pulverized to obtain a toner sample of this invention having an average particle size of about 13 to 15 microns. The above procedures were repeated in the same manner by using instead of the polystyrene (A) polystyrene (B) (Mw/Mn=2.6; Mn=12000; B & R=125±2° C.; Tg=97° C.), to obtain a comparative sample.

4 parts each of the thus obtained toner samples were mixed separately with 96 parts of an iron powder carrier having an average particle size of about 50 to about 80 microns to form 2 kinds of developers. Electrostatic latent images formed by a customary electrophotographic method were developed with these two toners respectively, and the resulting toner images were transferred on transfer sheets and fixed by fusing the toner images by a pressing contact with a fixing roller having a surface composed of FEP, which was maintained at 165° to 175° C. In order to examine whether or not the fixed toner was re-transferred to the roller surface to cause the offset phenomenon, just after completion of the fixing operation, transfer sheets free of a toner image were caused to have a pressing contact with the roller under the same conditions as above, and it was checked whether or not the transfer sheets were stained by the offset phonemenon.

As a result, it was found that when the comparative toner sample was used, the, transfer sheet was conspicuously stained by the offset phenomenon of the toner, whereas in the case of the sample toner of this invention the transfer sheet was not stained at all and it was confirmed that the offset phenomenon was not caused to occur at all.

EXAMPLE 2

Two toners were prepared in the same manner as Example 1 except that polystyrene (A1) (Mw/Mn=4.5; Mn=8300; B & R=125±2° C.; Tg=97° C.) and polystyrene (A2) (Mw/Mn=25; Mn=1900; B & R=125±2° C.; Tg=—) were used separately instead of the polystrene (A) used in Example 1.

The offset characteristics of these toners were examined in the same manner as in Example 1 except that a fixing roller having a surface composed of Daifuron was used as the fixing roller and the fusing temperature was changed to 180° to 190° C. It was confirmed that in each of the two samples the offset phenomenon was not caused at all.

EXAMPLE 3

100 parts of a styrene (70 parts)-butyl methacrylate (30 parts) copolymer (A) (Mw/Mn=4.6; Mn=17000; B & R=140±2° C.; Tg=74° C.) was mixed with 5 parts of Dia Black SH (carbon black manufactured by Mitsubishi Kasei) and 2.5 parts of Oil Black BW (Nigrosine dye manufactured by Orient Kagaku), and the mixture was treated in the same manner as in Example 1 to obtain a toner sample of this invention. The above procedures were repeated similarly by using instead of the copolymer (A) a styrene (70 parts) butyl methacrylate (30 Parts) copolymer (Mw/Mn=3.0; Mn=23,000; B & R=140±2° C.; Tg=74° C.), to obtain a comparative toner.

The offset characteristics of these two toners were examined in the same manner as in Example 1 except that the fusing temperature was changed to 200° to 210° C. In the case of the comparative sample, the offset phenomenon was observed, but in the case of the toner sample of this invention it was confirmed that the offset phenomenon was not caused to occur at all.

EXAMPLE 4

100 parts of a styrene (50 parts)-methyl methacrylate (20 parts)-butyl methacrylate (30 parts) copolymer (A1) (Mw/Mn=5.4; Mn=11,000; B & R=140±2° C.; Tg=72° C.) was mixed with 5 parts of Dia Black SH and 2 parts of Oil Black BW and the mixture was treated in the same manner as in Example 1 to obtain a toner sample of this invention. The above procedures were repeated in the same manner by using instead of the copolymer (A1) a styrene (50 parts)-methyl methacrylate (20 parts)-butyl methacrylate (30 parts) copolymer (B1) (Mw/Mn=2.8; Mn=19000; B & R=140±2° C.; Tg=72° C.), to obtain a comparative sample toner.

The offset characteristics of these two toners were examined in the same manner as in Example 1 except that a roller having a surface composed of Daifuron was used as the fixing roller and the fusing temperature was changed to 190° to 200° C. In the case of the comparative sample, occurrence of a conspicuous offset phenomenon was observed, but in the case of the toner sample of this invention it was confirmed that the offset phenomenon was not caused to occur at all.

EXAMPLE 5

A toner sample was prepared in the same manner as in example 4 except that a styrene (50 parts)-methyl methacrylate (20 parts)-butyl methacrylate copolymer (A2) (Mw/Mn=6.5; Mn=9800; B & R=140±2° C.; Tg=72° C.) was used instead of the copolymer (A1), Peares 155 was used instead of Dia Black SH (manufactured by Orient Kagaku) and Oil Black BS (manufactured by Orient Kagaku) was used instead of Oil Black BW.

The offset characteristics of the so obtained toner were examined in the same manner as in Example 1 except that the fusing temperature was changed to 210° to 220° C. It was found that the offset phenomenon was not caused at all.

EXAMPLE 6

A toner sample was prepared in the same manner as in Example 4 except that a styrene (50 parts)-methyl methacrylate (20 parts)-butyl methacrylate (30 parts) copolymer (A3) (Mw/Mn=8.2; Mn=9100; B & R=140±2° C.; Tg=72° C.) was used instead of the copolymer (A1), MA-8 (carbon black manufactured by Mitsubishi Kasei) was used instead of Dia Black SH and Oil Black BS (Nigrosine dye manufactured by Orient Kagaku) was used instead of Oil Black BW.

The offset characteristics of the so obtained toner were examined in the same manner as in Example 1 except that the fusing temperature was changed to 230° to 240° C. It was confirmed that the offset phenomenon was not caused at all.

EXAMPLE 7

85 parts of a methyl methacrylate (82 parts)-butyl methacrylate(18 parts) copolymer (A4) (Mw/Mn=4.2; Mn=8500; B & R=135±2° C.; Tg=85° C.) and 15 parts of the same polystyrene (B) as used in Example 1 were mixed with 4.5 parts of MA-8 and 1.5 parts of Nigrosine Base EX, and the mixture was treated in the same manner as in Example 1, to obtain a toner sample of this invention. The above procedures were repeated similarly by using 10 parts of the copolymer (A4) and 90 parts of the polystyrene (B), to obtain a comparative toner sample. Resin components of these samples and comparative sample had the following properties:

Resin of Sample

Mw/Mn=3.9; Mn=8900; B & R=135±2° C.; Tg=85° C.

Resin of Comparative Sample

Mw/Mn=2.7; Mn=11500; B & R=125±2° C.; Tg=96° C.

The offset characteristics of these two toners were examined in the same manner as in Example 1 except that a roller having a surface composed of FEP was used as the fixing roller and the fusing temperature was changed to 160 ° to 170° C. In the case of the comparative sample, it was found that the offset phenomena was conspicuous, but in the case of a sample of this invention it was confirmed that the offset phenomenon was not caused at all.

EXAMPLE 8

60 parts of the same polystyrene (A1) as used in Example 2 and 50 parts of the same copolymer (A4) as used in Example 7 were mixed with 5 parts of Peares 155 and 2 parts of Nigrosine Base EX, and the mixture was treated in the same manner as in Example 1, to obtain a toner.

The offset characteristics of the so obtained toner were examined in the same manner as in Example 1 except that a roller having a surface composed of Daifuron was used as the fixing roller and the fusing temperature was changed to 180° to 190° C. It was conifrmed that the offset phenomenon was not caused at all.

EXAMPLE 9

100 parts of a styrene (80 parts)-vinyl toluene (20 parts) copolymer (A5) (Mw/Mn=4.0; Mn=14000; B & R=150±2° C.; Tg=100° C.) was mixed with 6 parts of Peares 155 and 2.5 parts of Nigrosine Base EX, and the mixture was treated in the same manner as in Example 1 to obtain a toner sample of this invention. The above procedures were repeated similarly by using instead of the copolymer (A5) a styrene (80 parts)-vinyl toluene (20 parts) copolymer (B2) (Mw/Mn=3.3; Mn=17,000; B & R=150±2° C.; Tg=100° C.), to obtain a comparative toner sample.

The offset characteristics of these two toners were examined in the same manner as in Example 1 except that the fusing temperature was changed to 190° to 200° C. In the case of the comparative sample, it was found that the offset phenomenon was conspicuous, but in the case of the sample toner of this invention, it was confirmed that the offset phenomenon was not caused to occur at all.

EXAMPLE 10

95 parts of a styrene (85 parts)-acrylonitrile(15 parts) copolymer (A6) (Mw/Mn=10; Mn=8500; B & R=145±2° C.; Tg=—) and 5 parts of poly (methyl methacrylate) (Mw/Mn=20; Mn=3200; B & R=145±2° C.; Tg=—) were mixed with 6 parts of Dia Black SH and 2.5 parts of Oil Black BS, and the mixture was treated in the same manner as in Example 1 to obtain a toner sample of this invention. The above procedures were repeated similarly by using instead of the copolymer (A6) a styrene (85 parts)-acrylonitrile (15 parts) copolymer (B3) (Mw/Mn=2.5; Mn=22,000; B & R=145±2° C.; Tg=103° C.), to obtain a comparative toner sample. The resin components of these samples and comparative sample had the following characteristics:

Resin of Sample
Mw/Mn=11; Mn=7800; B & R=145±2° C.; Tg=103° C.

Resin of Comparative Sample
Mw/Mn=3.3; Mn=17000; B & R=145±2° C.; Tg=103° C.

The offset characteristics of these two toners were examined in the same manner as in Example 1 except that a roller having a surface composed of Daifuron was used as the fixing roller and the fusing temperature was changed to 190° to 200° C. In the case of the comparative sample, it was found that the offset phenomenon was conspicuous, but in the case of the sample of this invention, it was confirmed that the offset phenomenon was not caused to occur at all.

EXAMPLE 11

100 parts of the same polystyrene (A1) as used in Example 2 was mixed with 6 parts of MA-8 and 3 parts of Nigrosine Base EX, and the mixture was treated in the same manner as in Example 1 to obtain a sample A. The above procedures were repeated similarly by further adding 5 parts of Hoechst Wax C (amide was manufactured by Hoechst Japan), to obtain a sample B. The above procedures were repeated similarly by using 2 parts of zinc stearate instead of the Hoechst Wax C to obtain a sample C.

The offset characteristics of these three samples were examined in the same manner as in Example 1 except that a roller having a surface composed of Daifuron was used as the fixing roll and the fusing temperature was changed to 180° to 190° C. In each of these samples, it was confirmed that the offset phenomenon was not caused to occur at all.

At the pulverizing step of the toner-preparing process, it was found that in the case of samples B and C, occurrence of excessive pulverization was conspicuously reduced as compared with the case of the sample A and excessive pulverization was hardly caused.

EXAMPLE 12

100 parts of the same copolymer (A2) as used in Example 5 was mixed with 5 parts of Dia Black SH and 2 parts of Oil Black BS, and the mixture was treated in the same manner as in Example 1 to obtain a toner sample A. The above procedures were repeated similarly by further adding 1 part of barium stearate to obtain a toner sample B. The above procedures were repeated similarly by using 4 parts of Plast Flow (ethylene-bis-stearoyl amide manufactured by Nitto Kagaku) instead of the barium stearate to obtain a toner sample C.

The offset characteristics of the so obtained three toner samples were examined in the same manner as in Example 1 except that a roller having a surface composed of FEP was used as the fixing roller and the fusing temperature was changed to 180° to 190° C. In each of these toner samples, it was confirmed that the offset phonomenon was not caused to occur at all. When these toners were used repeatedly, it was found that in the case of samples B and C the frictional charge characteristics were not changed for a longer time than in the case of the sample A and the samples B and C had a longer life than the sample A.

EXAMPLE 13

95 parts of a styrene (85 parts)-ethylhexyl acrylate (15 parts) copolymer (Mn/Mn=4.5; Mn=11,000; B & R=135±2° C.; Tg=74° C.) and 5 parts of polyvinyl butyral (Mw/Mn=2.4; Mn=23000; B & R=115±2° C.; Tg=62° C.) were mixed with 6 parts of Peares 155, 1.5 parts of Nigrosine Base EX and 5 parts of Plast Flow, and the mixture was treated in the same manner as in Example 1 to obtain a toner.

The offset characteristics of the so obtained toner were examined in the same manner as in Example 1 except that a roller having a surface composed of FEP was used as the fixing roller and the fusing temperature was changed to 160° to 170° C. It was confirmed that the offset phenomenon was not caused to occur at all.

EXAMPLE 14

100 parts of a styrene (95 parts)-lauryl methacrylate (5 parts) copolymer (Mw/Mn=4.6; Mn=10,000; B & R=135±2° C.; Tg=91° C.) was mixed with 5 parts of MA-8, 2.5 parts of Nigrosine EX and 5 parts of Hoechst Wax C, and the mixture was treated in the same manner as in Example 1 to obtain a toner.

The offset characteristics of the so obtained toner were examined in the same manner as in Example 1 except that a roller having a surface composed of FEP was used as the fixing roller and the fusing temperature was changed to 170° to 180° C. It was confirmed that the offset phenomenon was not caused to occur at all.

What we claim is:

1. A toner for developing electrostatic latent images which comprises a resin, said resin containing at least 60% by weight, based on the weight of said resin, of at least one polymer selected from the group consisting of (a) a copolymer of an aromatic vinyl monomer with at least one other $\alpha$-methylene aliphatic monocarboxylic acid ester and (b) a copolymer of 62 -Methylene aliphatic monocarboxylic acid ester, said polymer having a weight average molecular weight (Mw)/number average molecular weight (Mn) ratio of from 3.5 to 40 wherein the number average molecular weight (Mn) is between about 2,000 and about 30,000.

2. The toner of claim 1, wherein said Mw/Mn ratio is between about 4.0 and about 30.

3. The toner of claim 1, wherein said polymer has a softening point of from about 100° to about 170° C.

4. The toner of claim 1, wherein said aromatic vinyl monomer is a styrene.

5. The toner of claim 4, wherein said aromatic vinyl monomer is styrene.

6. The toner of claim 1, wherein said -methylene aliphatic monocarboxylic acid ester is at least one monomer selected from the group consisting of an acrylic acid ester and a methacrylic acid ester.

7. The toner of claim 1, wherein said polymer has a glass transformation point of about 20° to about 120° C.

8. The toner of claim 1, wherein said copolymer is at least 30 mole % aromatic vinyl monomers.

9. The toner of claim 1 further comprising a colorant.

10. The toner of claim 9, wherein said colorant is carbon black.

11. A toner for developing electrostatic latent images which comprises a resin, said resin containing at least 60% by weight, based on the weight of said resin, of at least one polymer selected from the group consisting of polystyrene, styrene-butyl methacrylate copolymers, methyl methacylate-butyl methacrylate copolymers, styrene-vinyl toluene copolymers, styrene-acrylonitrile copolymers, styrene-ethylhexyl acrylate copolymers, styrene-lauryl methacrylate copolymers and styrene-methyl methacrylate-butyl methacrylate copolymers, said polymer having a weight average molecular weight (Mw)/number average molecular weight (Mn) ratio of from 3.5 to 40 wherein the number average molecular weight (Mn) is between about 2,000 and about 30,000.

12. A toner for developing electrostatic latent images which comprises a resin, said resin containing at least 60% by weight, based on the weight of said resin, of at least one polymer selected from the group consisting of styrene-methyl methacrylate-butyl methacrylate copolymers, said polymer having a weight average molecular weight (Mw)/number average molecular weight (Mn) ratio of from 3.5 to 40 wherein the number average molecular weight (Mn) is between about 2,000 and about 30,000.

* * * * *

UNITED STATES PATENT AND TRADEMARK OFFICE

CERTIFICATE OF CORRECTION

PATENT NO. : 4,486,524

DATED : December 4, 1984

INVENTOR(S) : FUJISAKI, et al

It is certified that error appears in the above-identified patent and that said Letters Patent is hereby corrected as shown below:

Column 19, line 11, change "62-Methylene" to --α-methylene --

Column 19, line 26, change "said -methylene" to --said α-methylene--

Signed and Sealed this

*Twenty-fourth* Day of *September 1985*

[SEAL]

*Attest:*

*Attesting Officer*

DONALD J. QUIGG

*Commissioner of Patents and Trademarks—Designate*